United States Patent [19]

Slatten et al.

[11] 4,239,417

[45] Dec. 16, 1980

[54] MULTI-PURPOSE MARINE STRUCTURE

[75] Inventors: Arvid Slåtten; Harald Bech; Olav Olsen, all of Oslo, Norway

[73] Assignees: A/S Hoyer-Ellefsen, Ing. T. Furuholmen A/S; Ing. F. Selmer A/S, both of Oslo, Norway

[21] Appl. No.: 961,205

[22] Filed: Nov. 16, 1978

[30] Foreign Application Priority Data

Nov. 23, 1977 [NO] Norway ..... 774004
Sep. 1, 1978 [NO] Norway ..... 783000

[51] Int. Cl.[3] ..... E02B 17/00

[52] U.S. Cl. ..... 405/195; 166/356; 405/210; 405/211; 405/224

[58] Field of Search ..... 405/195, 203, 205, 207, 405/210, 224; 114/256, 257, 264; 166/335, 356

[56] References Cited

U.S. PATENT DOCUMENTS 3,385,464 5/1968 Courbon ..... 405/207 X
3,703,207 11/1972 Horton ..... 405/203 X
3,835,654 9/1974 Lehanneur ..... 405/210
4,065,935 1/1978 Burrow et al. ..... 405/210 X

*Primary Examiner*—David H. Corbin
*Attorney, Agent, or Firm*—Larson, Taylor and Hinds

[57] ABSTRACT

A multi-purpose marine structure intended to be submerged and installed on a sea bed. The structure comprises an outer peripheral body and a tapered inner section. The outer peripheral body is intended to be founded on a sea bed and comprises a tubular ring-formed body of concrete, the base of which is constructed and arranged to rest on a sea bed along its entire base periphery. The inner section is also of concrete and is formed as a cone or polyhedron having a lower end which is fixed to the outer peripheral body, the inner section tapering upwardly and inwardly from its lower end. The inner section and outer body together form a monolithic integral concrete unit, the inner section being fixed to the outer body along the inner periphery of the outer body.

10 Claims, 16 Drawing Figures

Figure 1:
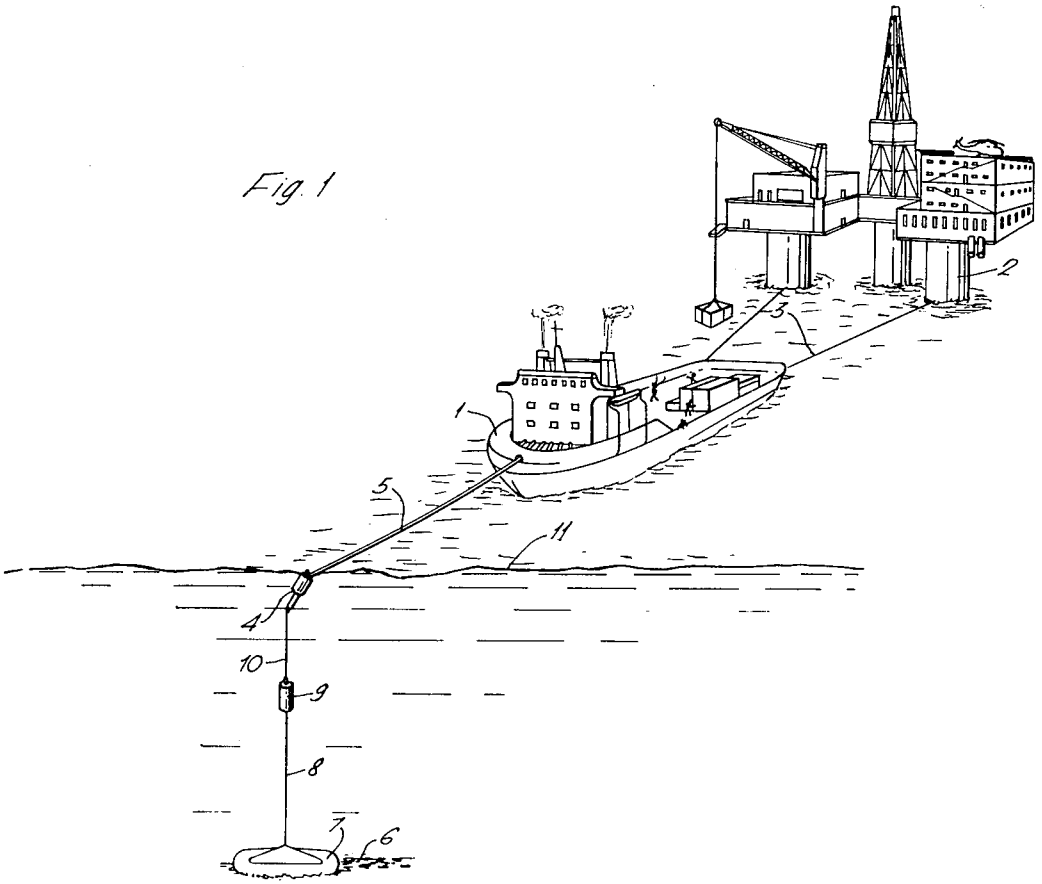

12
13
22
21

26
15
24
25
20

2
20
21
22
23
13
16
12
15
15
19
15
17
15

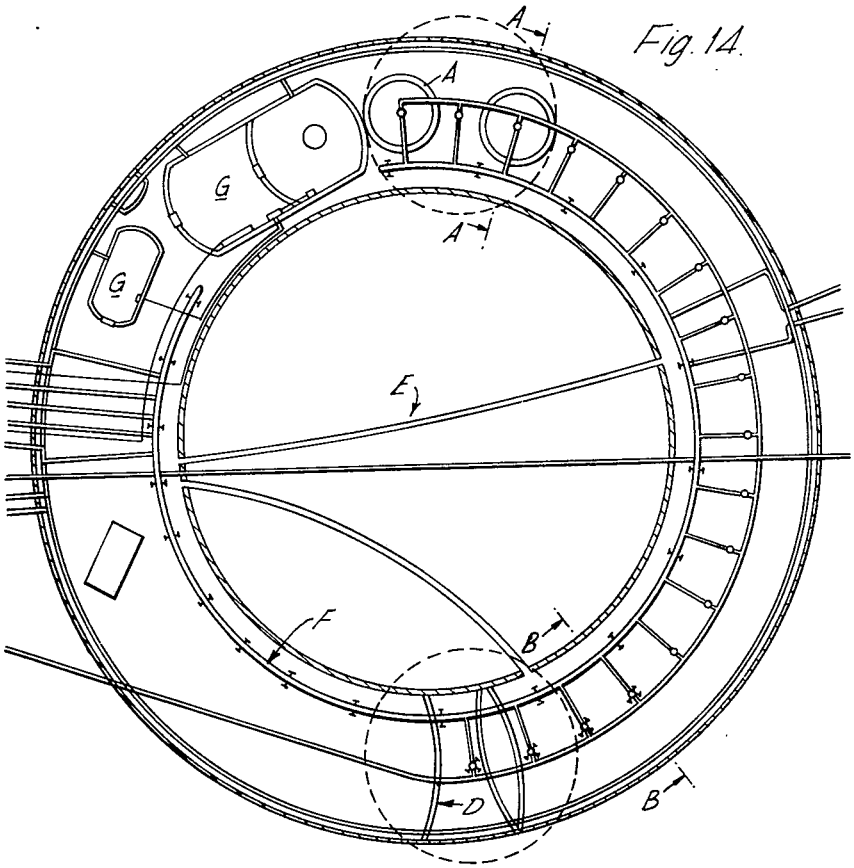
Fig. 14.
Fig. 15.
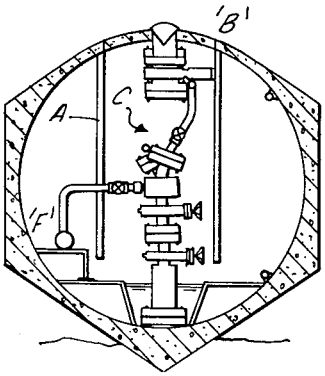
Fig. 16.
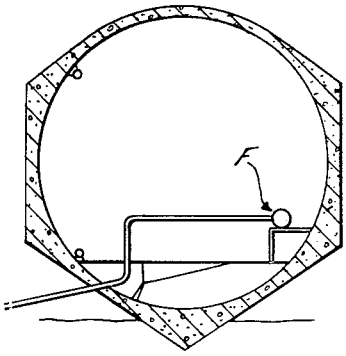

MULTI-PURPOSE MARINE STRUCTURE

This invention relates to a moveable buoyant element designed for being submerged to the seabed and anchored there. This buoyant element can be used for a number of different purposes or a combination of different purposes. For example the buoyant element may be used in connection with an anchorage system for anchoring a supply ship in the vicinity of a marine platform. Moreover said element may be used to protect seabed installations such as the well head and/or subsea completions. Moreover the buoyant element or several such elements may be used for anchoring an oil boom to be placed around the platform in the event of an oil leakage, spill or blow-out. Moreover the element according to this invention may be used for pulling a pipeline from a marine production/drilling platform to the element, or the element may be used as a foundation for a BOPS. Also the element or several such elements may be used in the installation phase to pull a marine platform into the desired position. Furthermore the element may be used as a manifold for connecting a number of different oil gas wells. In addition the element may be used to house processing equipment associated with the extraction and production of hydrocarbons. Moreover the element may be used as intermediate pulling station(s) for pipes/cables extending between a platform and, for example, a production element of a design corresponding to the element according to the present invention. This applies no matter whether the production element lies at the same level as or lower than the platform itself. It is also possible to use the anchor for anchoring a wave-operated electric power generating station and as an anchor/foundation for loading buoys.

Furthermore the element may be used for oil storage or as an anchor for large floating structures such as floating drilling and/or production platforms for exploratory and/or production drilling for hydrocarbons in deep waters. Moreover the element may be used as a riser base and can contain manifolds, valves etc.

The said versions of the element may be equipped with adaptors to receive diving bells and/or underwater craft.

When used in connection with oil/gas production the element can be filled with air and have atmospheric pressure. Or it can be filled with inert gas, or be filled with water at a pressure of 1 atmosphere. Alternatively the element can have full water pressure or a combination of the said conditions may be employed, depending upon which phase the operations have entered.

According to the present invention one or more stationary buoyant elements are used, resting on the seabed and located at a safe distance from a drilling and/or production platform. The buoyant element consists of a tubular ring formed by a polygon or torus plus an approximately conical, hollow central section. Ideally the said hollow ring element should be shaped as a torus formed by revolving a circular ring. However it should be mentioned that the torus may be formed by revolving a hollow polygon. Moreover the said hollow ring element may be composed of preferably cylindrical sections assembled to form a polygonal element. The approximately conical, hollow central section may be formed by a cone or a polygonal pyramid, preferably truncated. The said approximately conical central section is fixed in the hollow, ring-shaped element in such a manner that the transition between cone and ring is continuous, without any sharp bends or changes of shape, the said cone and the ring-shaped element preferably forming a monolithic whole. A preferred element is of concrete.

The greatest stresses to which the ring will be subjected will occur during submerging. Normally it will then have internal atmospheric pressure. Stress will become negligible after the concrete ring is filled with water. The design of the concrete ring is determined largely in consideration of the heavy external stresses arising from water pressure during submerging. The chosen form is especially advantageous because essentially only membrane stresses will occur.

When used to protect wellheads the element may internally be divided into compartments to isolate each wellhead. It is an advantage if these walls have a curved design.

To provide adequate retention of the element on the seabed, the underside of the element may be equipped with a skirt or ribs which are pressed down into the seabed. In essential respects the elements for the different purposes are very similar in design. However small modifications are necessary in order to satisfy, and depending upon, the various functions.

A number of advantages are achieved by using the buoyant element according to the present invention. Among other things it is possible to reduce the total development cost for a field, whereby marginal fields attain more potential interest. Depending upon their shape and size, shallow reservoirs will become substantially cheaper to develop. By using only one large, centrally located platform and a number of multi-purpose elements according to this invention, it will be possible to reduce field development costs. Among other things it will be possible to commence production only a short time after the central platform is installed and the first satellite well(s) are connected up. This facilitates early start-up and consequently an early cash flow.

Another advantage exists in being able to pull a pipeline from the platform to the satellite wells. The conventional method of laying pipelines has been to employ large pipe-laying vessels from which the pipeline is laid out and pulled in to the platform and up to the deck through so-called J tubes. According to the present invention this method is reversed, the lengths of pipe being welded together on the platform deck. From there the pipeline is pulled, either through J tubes or by other means, from the platform to the desired point. Use of a pipe-laying vessel thus becomes superfluous and the level of costs is reduced.

A further substantial advantage is that by using these buoyant elements as wellhead protection and installing the necessary oil/gas separating equipment inside the element, it becomes possible to separate oil and gas prior to transfer to the central platform, which reduces the wear/corrosion of pipe walls caused by the said mixture.

Broadly speaking applications for the element can be divided into two main groups, the one group consisting of cases where the element is used as anchorage, either for anchoring a supply vessel or oil boom or for pulling the principal structure into the desired position during the installation phase.

The other group consists of use for covering wellheads or as a foundation for the BOP stack, or as a manifold element for connecting pipelines from the different wells.

Figure 2:
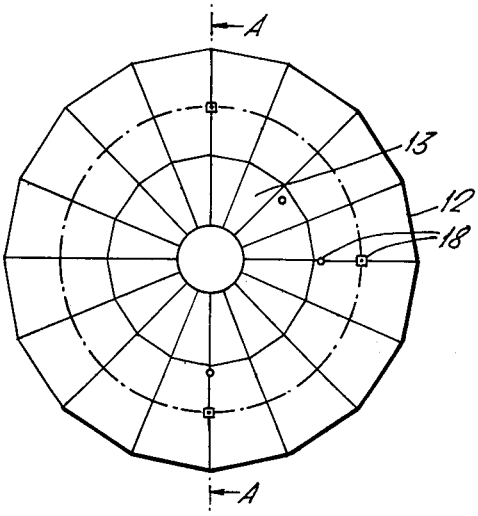
Figure 3:
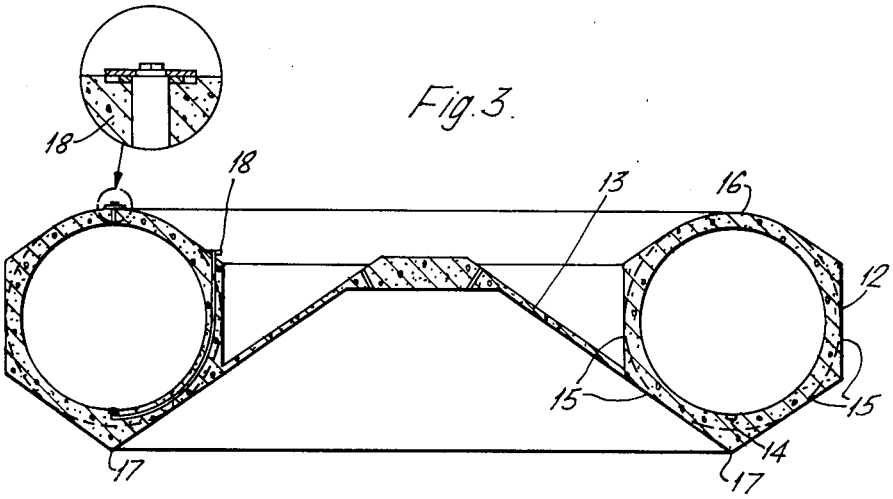
Figure 4:
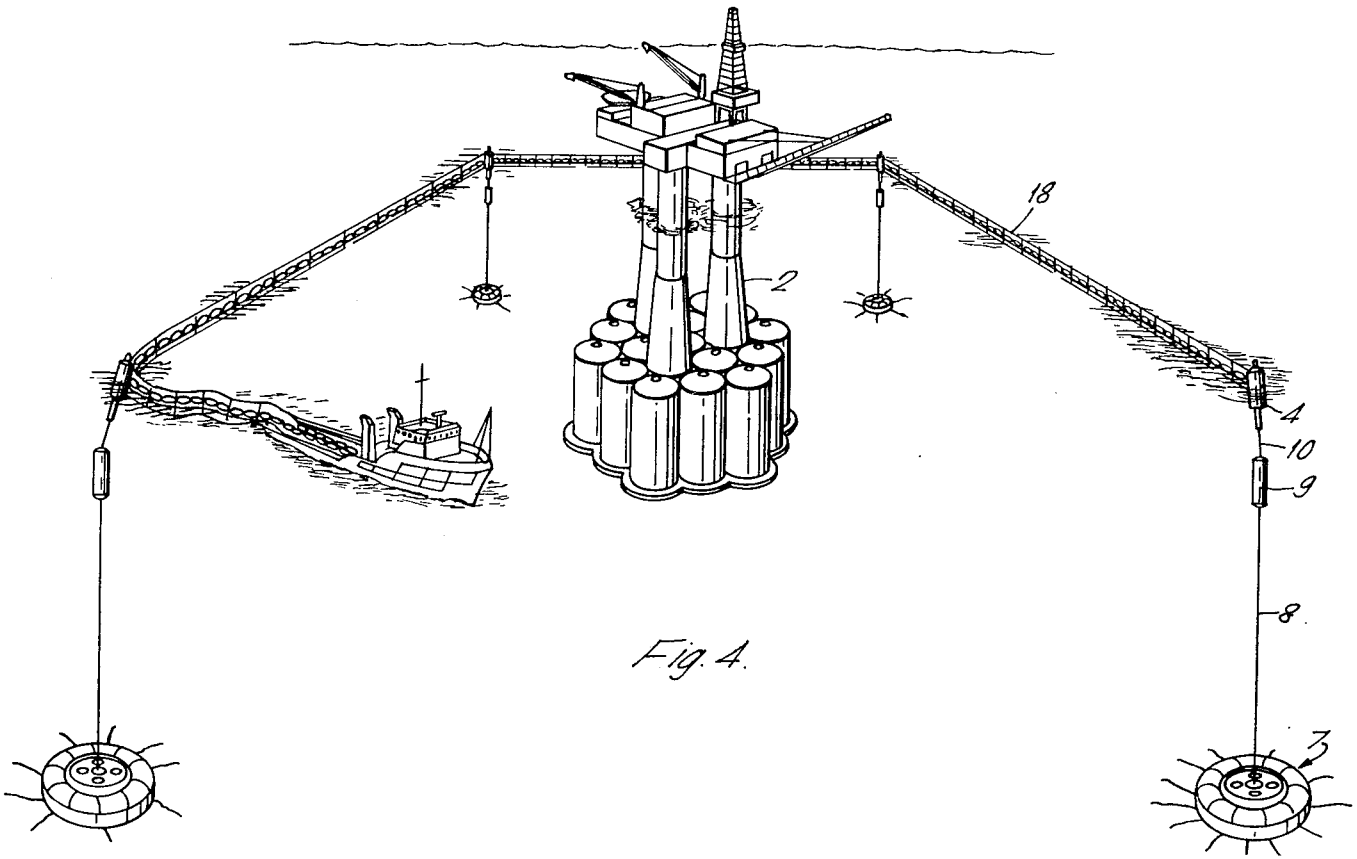
Figures 5, 6, 7:
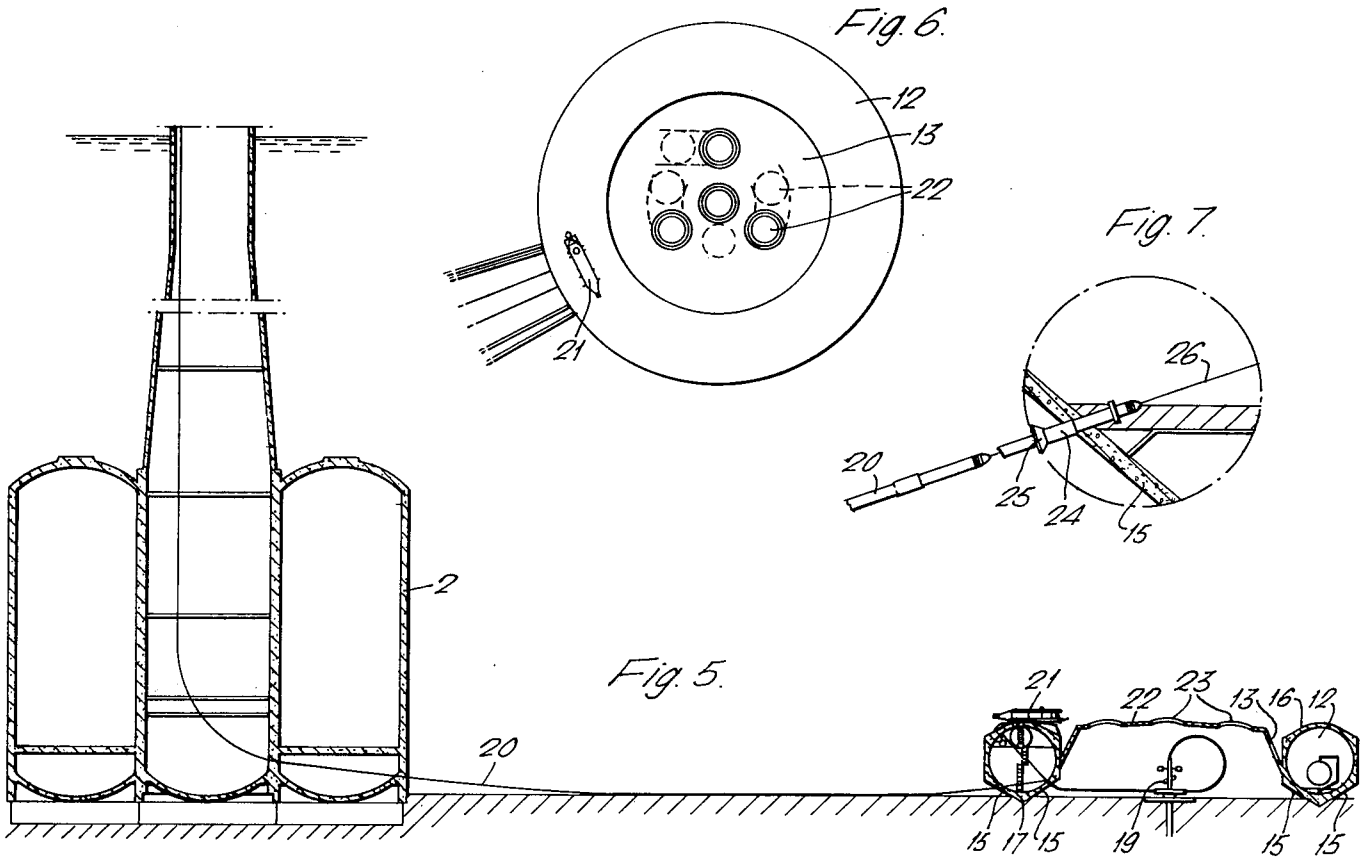
Figure 8:
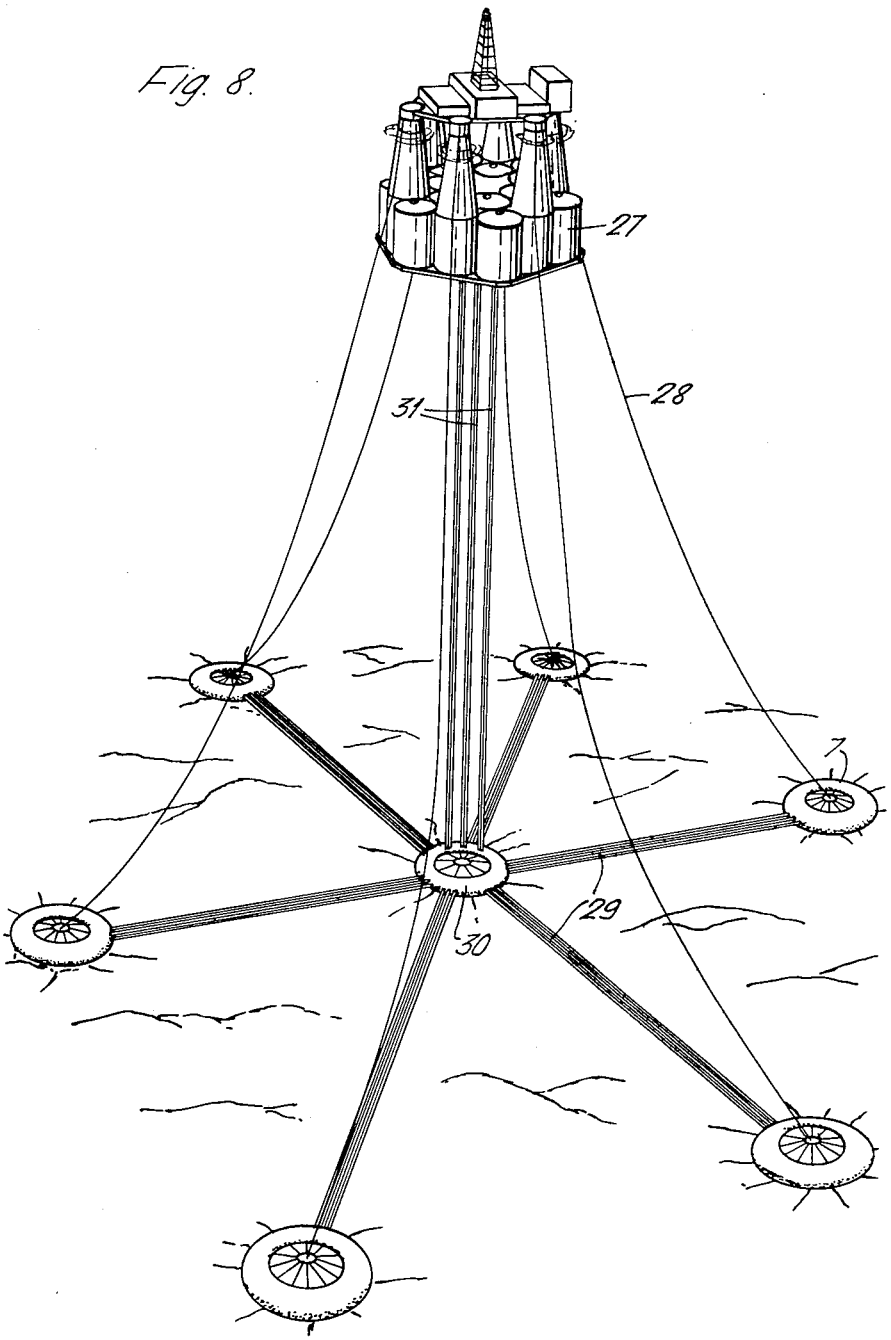
Figure 9:
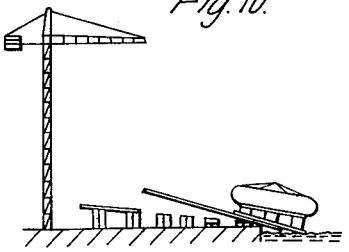
Figure 10:
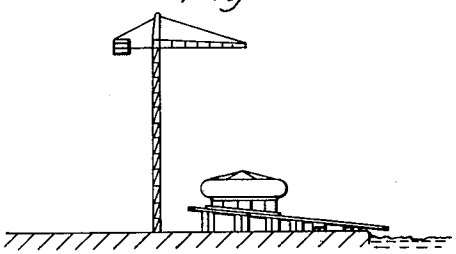
Figure 11:
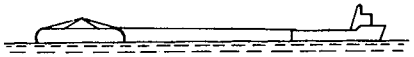
Figure 12:
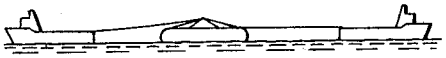
Figure 13:
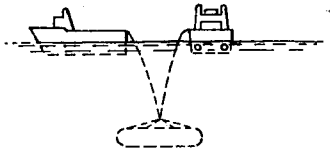

In the first instance, i.e. as an anchorage, the element can largely be designed as described in application No. 774004. However if the element is used to protect wellheads etc. the design is slightly different. These variations will appear from the following description with references to the drawings where:

FIG. 1 is a perspective drawing of a platform, a mooring buoy and a supply ship, FIG. 2 shows a horizontal plan of one embodiment of the anchorage element, FIG. 3 shows a vertical section along line A—A in FIG. 2, FIG. 4 is a perspective drawing of a gravity platform, anchorage elements and a supply ship in the process of laying an oil boom around the platform, the boom being held in position by means of the anchorage elements, FIG. 5 shows the element used as wellhead protection, a gravity platform and the interlinking pipeline, FIG. 6 shows a horizontal plan of the element shown in FIG. 5, FIG. 7 shows on a larger scale detail A indicated inside the ring in FIG. 5, FIG. 8 shows in perspective buoyant elements according to this invention used as manifold for the well and pipelines from other wells and/or as anchorage element for a semi-submerged floating platform, and FIGS. 9–13 show various stages of building the anchorage element FIGS. 14–16 show further details of the wellhead protection element of FIG. 5.

FIG. 1 shows in perspective a supply ship 1 anchored to a marine platform 2 by means of two wire ropes or hawsers 3 extending between the supply ship 1 stern and the platform 2. In addition the supply ship 1 is moored from the bow to a mooring buoy 4 via a forward wire rope or hawser 5 extending between the bows of the supply vessel 1 and the mooring buoy. The mooring buoy 4 is securely anchored to the seabed by means of an anchorage element 7 resting on the seabed 6, a lower anchorline 8, an intervening buoy 9 and an upper anchorline 10. The lower anchorline 8 is held taut preferably by the intervening buoy 9 having positive buoyancy. This reduces the wear on the lower anchorline 8 which in turn reduces inspection and maintenance frequency for this part. The said intervening buoy 9 preferably lies approximately 20–30 meters below the sea surface 11.

FIG. 2 shows a horizontal plan of the anchorage element 7 according to the present invention. This comprises a tubular, hollow ring element 12 plus a truncated cone 13 fitted centrally therein. The ring element 12 consists of sixteen uniform and approximately cylindrical sections assembled to form a ring element 12 having sixteen sides. Preferably the hollow space in each of the said sections is cylindrical in shape with a circular cross-section. Ideally it is desirable that the ring element 12 is shaped as a torus formed by revolving a circular ring. However, for formwork purposes and reasons of economy, a torus-like ring element is preferred, composed of the above mentioned uniform, approximately cylindrical sections 14 as shown by the broken line in FIG. 3. For practical reasons the external surfaces of each section are given a form as shown in FIG. 3. The external surface is formed by fourplane surfaces 15 combined with a dome-like calotte 6. This simplifies both formwork and casting, as conventional formwork units can be used for the plane surfaces, while preferably the dome-like calotte is cast without formwork. The said four plane external surfaces 15 are so arranged relative to each other that two of the surfaces are parallel and vertical, while two form a V-shaped lower edge or rim 17. To a certain extent this edge 17 will act as an anchoring skirt. Alternatively the ring element may be provided with a skirt (not shown) or rib extending around the ring element which, together with or instead of the said edge, is designed to provide adequate anchorage for the ring element. The angle between the surfaces which form the said V is chosen so that the walls in the said "conical" element form a continuous, rectilinear extension. As shown in FIGS. 2 and 3 the anchorage element is provided with a ballast system for filling/draining ballast water in the ring element 12 if desired.

FIG. 4 is a perspective drawing of supply ship 1 in the process of laying an oil boom 18 around a marine platform 2 standing on the seabed. To anchor the oil boom 18 to the seabed around the marine platform 2, an anchoring system is used which largely corresponds to the anchoring system described in connection with FIGS. 1–3. This anchoring system comprises an anchorage element 7, a lower anchorline 8, an intervening buoy 9, an upper anchorline 10 and a buoyancy element/anchoring buoy 4. The number of anchorage units in the system is determined by the length of the oil boom 18. Said anchorage units are placed in advance in the desired positions around the platform 2. Said anchoring system can function also as an anchoring system for anchoring supply ships, corresponding to the system described in connection with the applications shown in FIGS. 1–3. In this context it should be mentioned that the said anchorage elements 7 can to advantage be installed prior to positioning the platform 2, whereby said anchorage elements 7 can be used for accurate positioning of the field, possibly above previously drilled and completed wells 19.

FIG. 5 shows the element 7 used as protective casing fitted over wellheads 19 to protect them. Said satellite well 19 is linked with production platform 2 by pipelines 20. In this case the ring element 12 can be partly or fully air-filled. Moreover the element 7 is provided with adaptors for receiving diving bells/underwater craft 21. In addition the ring element 12 contains any equipment that may be required in connection with wellhead 19 maintenance/repairs. As shown in FIG. 5 the element 7 has a slightly modified form, the walls of the truncated cone 13 being more vertical than shown in the previous drawings. Moreover the horizontal section 22 of the truncated cone/pyramid 13 is larger. Said area 22 is provided with a number of closable openings 23. These openings 23 are provided to facilitate drilling/maintenance of the wells 19.

FIG. 6 shows a horizontal plan of the element shown in FIG. 5.

FIG. 7 shows a detail on a larger scale. Details are denoted "Detail A" in FIG. 5. More specifically FIG. 7 shows two stages of pulling the pipeline 20 from the platform 2 to the element 7. The one stage is immediately before the pipeline 20 is pulled through the plane surface 15 of the ring element 12, while the other stage is after the pipeline 20 has been pulled through a bushing 24 provided in the wall 15. For this purpose the bushing 23 is provided with conventional sealing and fastening means (not shown) for sealing and fastening the pipe 20 to the bushing 24, as well as a so-called bell mouth 25. The pipeline 20 is pulled from the platform 2 toward the element 7 by means of wires 26 and one or more winches, tackle etc. provided in the ring element 12. Said winches, tackle etc. are indicated but are not shown in detail in FIG. 5. If desired the diameter of the pipe 20 may be so large that the cross-sectional area is sufficient to house a number of separate oil/gas transfer pipelines, and possibly to house a transport system to carry personnel from the platform 2 to the ring element 12 or vice versa. Such a large pipe could also be designed to contain other units and equipment besides serving other functions, without departing from the idea of the invention.

FIG. 8 is a perspective drawing of the elements 7 according to the invention used as manifold for pipelines 20 from various satellite wells 19 and as anchorage elements for anchoring a semi-submersible platform. Moreover FIG. 8 shows the element 7 used as wellhead 19 protection. The drawing shows a floating platform 27 anchored to the seabed 6 by means of anchorlines 28. These anchorlines are in turn anchored to the seabed 6 by means of anchorage elements 7. In the example shown the anchorage element also forms a protective casing fitted over wellheads 19. However it should be noted that, owing to the satellite wells being at a distance from the actual anchorage site, the said anchorage elements must necessarily consist of separate anchorage elements, in contrast to the system shown in FIG. 8. Oil is transferred from the satellite wells 19 through pipelines 29 to a manifold element 20, and from there on to the floating platform 27 through risers 31.

Moreover at the same time the element 7 can be put to combined use as wellhead protection and manifold station. In this context it should be mentioned that the wellheads 19 can either be arranged inside the truncated cone/pyramid 13 or may be inside the ring element 12. If the wells 19 are inside the truncated cone/pyramid 13, they are under full water pressure. On the other hand, if the wells 19 terminate in the ring element 12, they can be under air or alternatively atmospheric pressure. In the event that the wells 19 terminate inside the truncated cone/pyramid 13, any manifold could be in the ring element 12. In this context it should be mentioned that the BOP stack can either be fitted on top of and outside the ring element 12 or it can be fitted inside the ring element 12.

FIGS. 9–13 show various stages of a proposed procedure for building and installing the element according to this invention.

The torus containing the manifold and wellheads may be adapted for various applications.

The openings B in the top of the torus may be so large that the whole BOP stack passes through the opening and is installed on a concrete slab in the bottom. When drilling is completed the Xmas tree C is installed in the conventional manner and a large concrete/steel cover is fitted on top of the opening in the torus.

A cylindrical wall A cast in steel or concrete can be fitted around the Xmas tree to separate it from the remainder of the cavity. This wall need not extend fully to the bottom, but may be suspended from the roof of the cavity as shown in FIG. 15.

The cavity can then be filled with water up to slightly above the lower section of this cylinder A. Any leaking gas or oil would thereby be prevented from penetrating into the other section of the cavity. For repairs it would in that event be necessary to dive under the cylinder edge to gain access to the Xmas tree C and the leakage. The cavity inside the cylinder could then be filled with non-explosive gas. It would also be possible to operate with differing pressures inside the cylinder A relative to the remainder of the cavity. This would facilitate relatively early registration of any excess pressure building up inside the cylinder A due to leakage from the Xmas tree.

In addition the cavity can be divided into two or more sections by building walls D. These walls can be arched to be better able to withstand pressure and to lessen the stresses on the circular external walls.

Upright walls D may also be used.

Such arched or upright walls D of concrete or steel may also be fitted to isolate each well installation.

The structure may also be installed with so-called J tubes E whereby oil/gas pipelines can be pulled to other, smaller satellite installations, but where at the same time manifold F will be used in the described structure.

One or more structures G should be installed for protection of personnel. The drawing shows a workplace/accommodation, an operating chamber and a transfer chamber to an underwater vessel or diving bell. These chambers G may be built of either steel or reinforced concrete. The cylinder/torus can contain separators and processing equipment too.

We claim:

1. A multi-purpose marine structure for installing on a sea bed and intended to be completely submerged below water when in use comprising an outer peripheral body intended to be founded on a sea bed, said peripheral body comprising a tubular ring-formed body of concrete, the base of which is constructed and arranged to rest on a sea bed along its entire base periphery and an inner, centrally arranged, tapered hollow section of concrete, said tapered section being formed as a cone or polyhedron and having a lower end rigidly fixed to the outer peripheral body and tapering upwardly and inwardly therefrom, said inner section and outer peripheral body together forming a monolithic integral concrete unit, the inner tapered section being fixed to the outer peripheral body along the inner periphery of said peripheral body.

2. A structure according to claim 1 wherein said outer peripheral body is formed as a torus.

3. A structure according to claim 2 wherein said torus is one which is formed by rotating a circular ring and wherein said tapered inner section is formed as a cone.

4. A structure according to claim 3 wherein said cone is truncated.

5. A structure according to claim 1 wherein said outer peripheral body comprises a plurality of cylindrical sections arranged to form a hollow polygon and wherein said tapered inner section is formed as a polyhedron having sides corresponding to the sides of said cylindrical sections forming said polyhedron.

6. A structure according to claim 1 wherein the outer surface of said outer peripheral body is a polygon in vertical cross section and wherein the inner section is in the form of a polygonal pyramid.

7. A structure according to claim 6 wherein said polygon is arranged such that two adjacent sides thereof form a cutting edge which forms the base periphery of said outer peripheral body for resting on a sea bed.

8. A structure according to claim 6 wherein the upper portion of said outer peripheral body is formed, in vertical cross section, as a dome-like calotte.

9. A structure according to claim 1 wherein said tapered inner section and said outer peripheral body are formed monolithically with the wall of the tapered inner section forming a continuous rectilinear extension of a wall of said peripheral body.

10. A structure according to claim 1 wherein the tapered inner section is provided with closeable openings.

* * * * *